United States Patent [19]

Pelloux-Gervais et al.

[11] Patent Number: 4,612,773

[45] Date of Patent: Sep. 23, 1986

[54] CRYOGENIC LIQUID DISTRIBUTING DEVICE

[75] Inventors: Pierre Pelloux-Gervais, Seyssins; Jean-Louis Neret, Morangis, both of France

[73] Assignee: L'Air Liquide, Societe Anonyme pour l'Etude et l'Exploitation des Procedes Georges Claude, Paris, France

[21] Appl. No.: 797,833

[22] Filed: Nov. 13, 1985

[30] Foreign Application Priority Data

Nov. 13, 1984 [FR] France ..... 84 17237

[51] Int. Cl.[4] ..... F17C 7/02

[52] U.S. Cl. ..... 62/50; 62/51; 62/55; 222/3

[58] Field of Search ..... 62/50, 51, 55; 222/3

[56] References Cited

U.S. PATENT DOCUMENTS 2,502,588 4/1950 Preston et al. ..... 62/50
3,201,947 8/1965 Pauliukonis ..... 62/50

FOREIGN PATENT DOCUMENTS 0109134 5/1984 European Pat. Off. .
2496837 6/1982 France .

*Primary Examiner*—Ronald C. Capossela
*Attorney, Agent, or Firm*—Young & Thompson

[57] ABSTRACT

This device, which is in particular intended to inject liquid nitrogen in preserving cans so as to pressurize them, comprises an inverted cryogenic container (1,2) having a neck (3) closed by a detachable plate (10). All the elements (11,12,14,19,21) for operating the device extend through this plate in a sealed manner. The pouring conduit (14) has a calibrated orifice (17) mounted in the plate (10) and, above the latter, an electrically-operated valve immersed in the liquid. Application in the packing of flat beverages in metal cans.

13 Claims, 3 Drawing Figures

CRYOGENIC LIQUID DISTRIBUTING DEVICE

The present invention relates to a device for distributing a cryogenic liquid. It is in particular adapted to provide a continuous small stream of liquid nitrogen to a succession of preserving cans travelling along on a conveyor, just before their closure by a forming-over operation.

Manufacturers of containers, in particular metal cans for widely consumed liquids such as beverages, have been obliged for reasons of costs, to use increasingly thinner material, and in particular metal. Consequently, there is a reduction in the strength of these containers and a danger of crushing when they are stacked one on the other. While containers containing a product which gives off a gas, for example a carbonated beverage, resist crushing relatively well, this is not so for containers enclosing a non-gaseous liquid, for example a flat beverage such as mineral water, fruit juice, etc. Further, when these products (for example fruit juice) are sterilized and packed in the warm state, their contraction upon cooling is liable to deform the can. In this case there is provided an artificial pressurization of the containers before their cover is formed over, by the introduction of a few drops of liquified gas, generally nitrogen, so that the problem of crushing is overcome.

When this technique is applied to machines packing at a high rate, i.e. machines capable of filling 30,000 to 120,000 containers per hour arranged in a single file, there can be no question of interrupting the flow of liquid nitrogen between the successive containers. It is then preferred to allow a small stream of liquid nitrogen to flow continuously and accept a small loss of liquid between the successive containers which travel at high speed under the pouring orifice for this liquid.

An object of the invention is to provide a reliable device which is particularly convenient to construct, use and maintain. For this purpose, the invention provides a device for distributing a cryogenic liquid which comprises:

a cryogenic container having a double wall and which, in its position of use, is inverted and has, on one hand, an interior reservoir and an exterior case each defining a single opening at their lower end and, on the other hand, a neck interconnecting the two openings;

a plate fixed in the neck at the entrance of the interior reservoir, and a cryogenic liquid supply conduit, a venting conduit and a pouring conduit, these three conduits extending through said plate in a sealed manner.

According to advantageous features:

the pouring conduit is provided with an electrically-operated stop valve disosed above the plate and, if desired, means for controlling the electrically-operated valve also passed through this plate in a sealed manner;

the pouring conduit is provided, at the level of the plate and below the electrically-operated valve, with an insert having a calibrated orifice whose diameter is very much smaller than that of this conduit.

An embodiment of the invention will now be described with reference to the accompanying drawings, in which.

Figure 1:
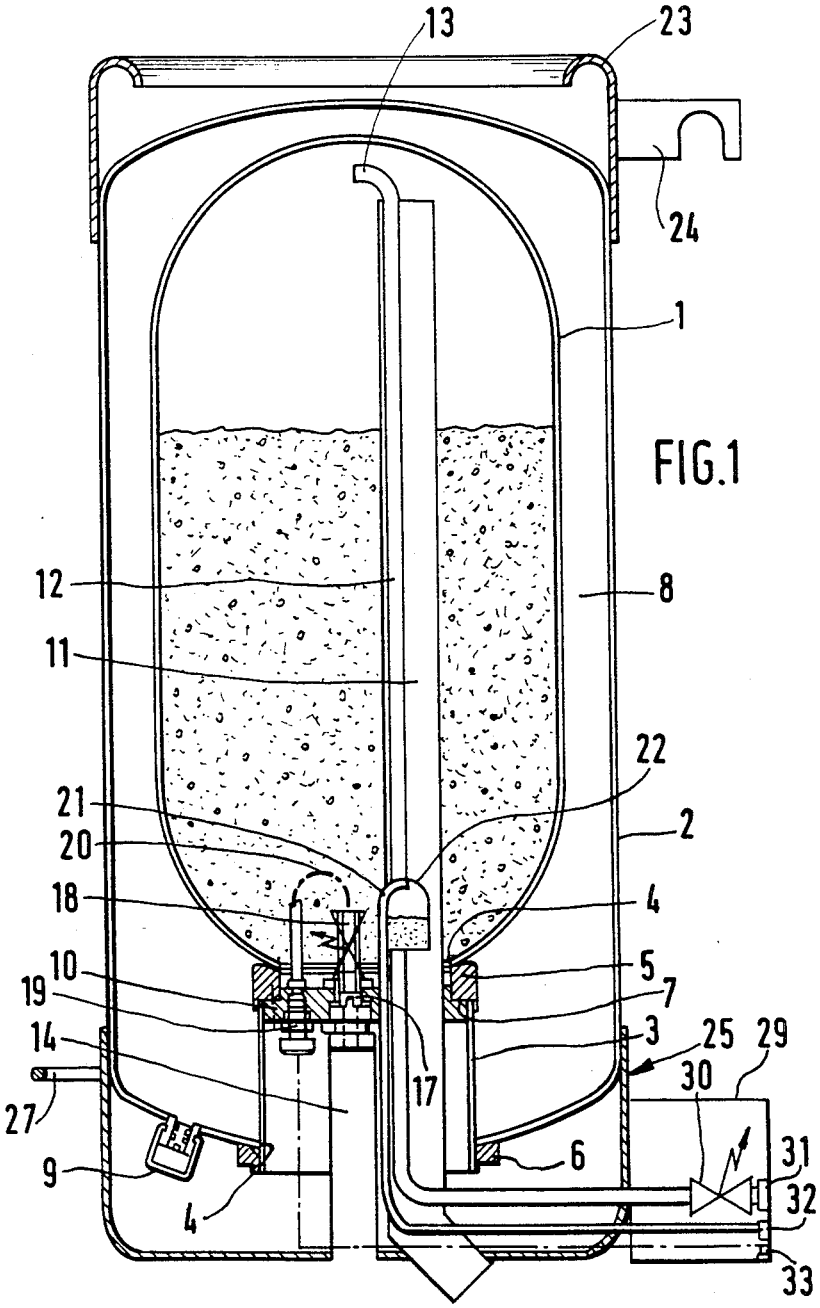
FIG. 1 is a longitudinal sectional view of a distributing device according to the invention.

The distributing device shown in the drawings in its position of use is adapted to supply a continuous thin stream of liquid nitrogen to a succession of cylindrical metal cans (not shown) which pass by just below the devide at high speed, contain a food product such as a non-gaseous beverage, and are driven in horizontal translation by a conveyor (not shown).

This device mainly comprises a cryogenic container of conventional construction consisting of an interior reservoir 1 having a volume on the order of one liter to several tens of liters, an exterior case 2 and a connecting neck 3, and disposed in the inverted position.

The interior reservoir 1 and the exterior case 2 which are for example made of aluminum, each have a cylindrical body part and two dished end walls, the interior end wall being provided with a large circular opening 4.

The neck 3 is a section of a tube fixed in a sealed manner by its ends to the periphery of the two openings 4 by means of respective thick rings 5,6. The ring 5 defines inside the neck 3 a horizontal annular shoulder 7 provided with a plurality of tapped holes facing downwardly.

Defined between the reservoir 1 and the case 2, is an annular space 8 providing an insulation under a high vacuum, the pumping being effected through a connector 9. By way of a modification, the insulation may be produced from an injected insulating material such as polyurethane or by any other suitable means.

Applied and centered on the shoulder 7 is a thick plate 10 which is secured by a few screws in a detachable manner on the inner ring 5. Extending through this plate in a sealed manner are the various following elements for operating the device:

a venting tube 11 which extends vertically from the upper part of the reservoir 1 to a position below the ring 6;

a liquid nitrogen supply tube 12 which extends into the tube 11 in a sealed manner below the ring 6, rises in the tube and terminates at the top of the reservoir 1 in the form of a pouring crook 13;

a liquid nitrogen discharging vertical conduit 14 provided at its upper end (FIG. 2) with a sleeve 15, for example composed of a plastics material, which is maintained in an aperture in the plate 10 by a nut 16. Positioned in the sleeve 15 is an insert 17 provided with a calibrated orifice whose diameter is much smaller than the diameter of this sleeve and the conduit 14. The sleeve 15 opens above the plate 10 onto the reservoir 1 and is capped by an electrically-operated valve 18 fixed on the upper side of this plate. This valve is an immersed cryogenic electrically-operated valve of a commercially availalble type;

a connector 19 allowing the passage of electric wires 20 controlling the valve 18, and a device for measuring the level, which, in the presently-described embodiment, is formed by a tube 21 adapted to be connected to a pressure gauge and terminating, slightly above the plate 10, in a downwardly open bell 22. For reasons of clarification of the drawing, only the upper part of this device has been shown in FIG. 2.

The tubes 11 and 21 are welded to the plate 10, while the detachable elements 15 and 19 are fixed by means of sealing elements. Likewise, a sealing element is provided between the ring 5 and the plate 10.

The device further comprises a rigid ring 23 welded to the upper end of the case 10 and provided with hooks 24 (only one of which is shosn in FIG. 1), and a lower cap 25. The latter is formed, on one hand, by a sleeve 26 welded to the lower end of the case 2 and provided with at least one handling handle 27, and, on the other hand, by a lower cover 28 detachably secured to the sleeve 26 and having the venting tube 11 and the conduit 14 extending therethrough.

Further, a connecting box 29 (not shown in FIG. 2) is fixed to the sleeve 26. This box encloses an electrically-operated valve 30 and coupling 31 assembly mounted on the end of the conduit 12, a coupling 32 to which the tube 21 extends, and an electric connector 33 to which the electric wires controlling the valves 18 and 30 lead.

The space remaining free in the neck and between the case 2 and the cap 25 is filled with a suitable heat insulating material 34.

When in use, the device is suspended by the hooks 24 from a suitable support (not shown), with the axis of the conduit 14 intersecting at a right angle the axis of the conveyor carrying the cans to be pressurized.

There are connected to the box 29 a conduit for drawing off liquid nitrogen stored under a pressure higher than atmospheric pressure (coupling 31), a pressure gauge (coupling 32) and an electric supply cable (connector 33).

With the electrically-operated valve 18 closed, the electrically-operated valve 30 is opened and this causes the filling of the reservoir 1 up to an upper level detected by the pressure gauge. In order to pour liquid nitrogen, the valve 18 is opened, this valve being completely immersed and therefore adding no heat. Pure liquid fills the sleeve 15, passes through the calibrated orifice of the insert 17 and freely flows in the form of a thin stream along the axis of the conduit 14 without touching the latter. The nitrogen vaporized in the reservoir 1 is discharged to the atmospheric pressure by the venting tube 11.

The jet of liquid nitrogen can be stopped at any moment by merely closing the valve 18. The reservoir 1 is filled automatically by actuating the electrically-operated valve 30 in an open or closed manner by means of signals delivered by the pressure gauge so as to maintain a roughly constant liquid height in the reservoir and consequently to obtain uniform conditions of distribution of liquid nitrogen in the cans to be pressurized.

The device described above has many advantages:

As to construction, the fact of having only one opening through which all the elements required for operation pass, greatly facilitates the construction of the cryogenic container. There is no mechanical fastening together and internal stresses are thus avoided. This advantage is valid if the insulation of the wall hollow 8 is filled with an injected insulating material and a fortiori in the case of an insulation under a vacuum whose thickness is smaller.

In use, the fact that all the functional parts are grouped at the base of the device permits the use of a centralized connection system (connecting box 29). This convenience is appreciable both when assembling and when carrying out a possible maintenance intervention.

In order to disassemble the device, it is sufficient to disconnect the connections of the box 29; raise the container so as to unhook it; invert it, even if it is full of liquid nitrogen; remove the cover 28 and the insulation 34; and then unscrew and then withdraw the plate 10 and therewith all of the elements it carries. This permits in particular the changing of the insert 17 so as to modify the flow of liquid nitrogen.

The supply of liquid nitrogen and the discharge of gaseous nitrogen through the neck 3 in the immediate vicinity of the conduit 14, contributes to the cooling of the lower region of the device.

Figure 2:
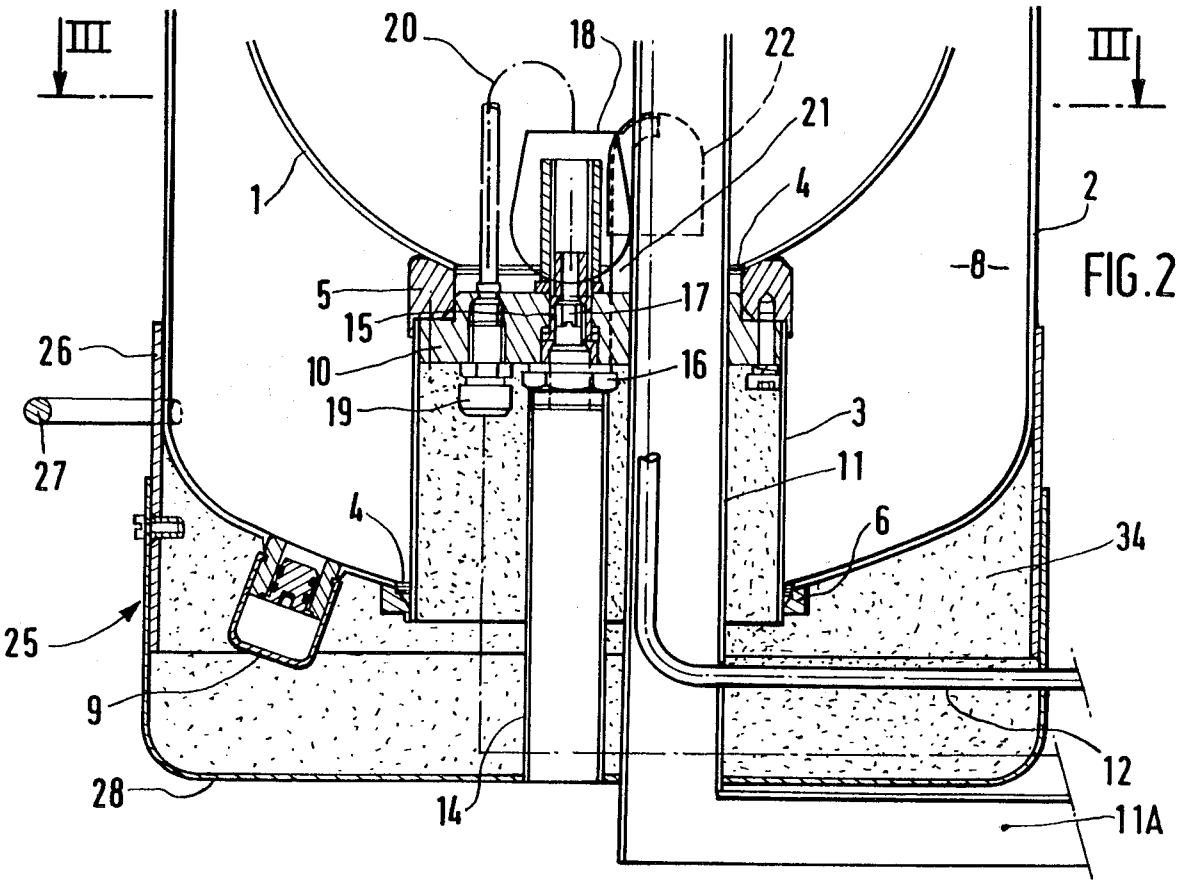
FIG. 2 is a detailed view to an enlarged scale of the lower part of this device.
Figure 3:
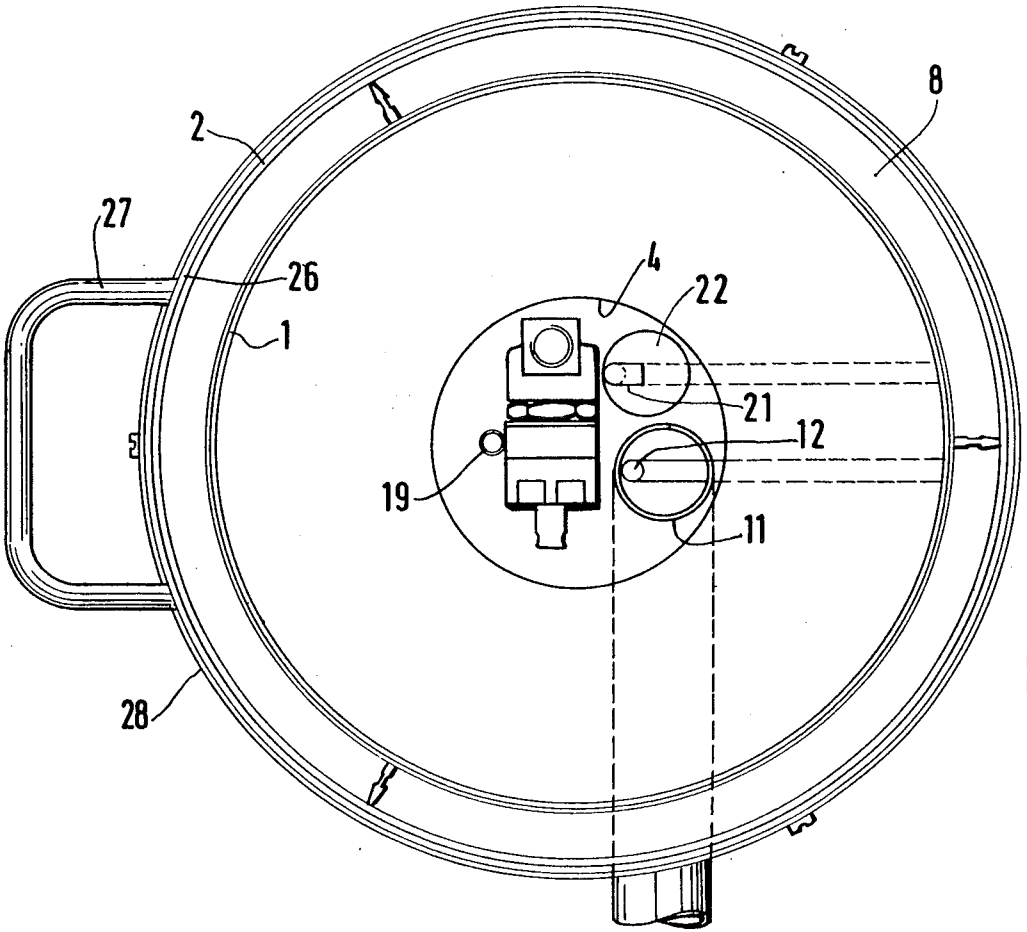
FIG. 3 is a cross-sectional view taken on line III—III of FIG. 2.

By way of a modification, shown in FIG. 2, the outer part of the venting tube 11 may be put in the form of a tunnel 11A placed above the conveyor so as to produce a more or less inert protective atmosphere in the gaseous volume existing within the cans to be pressurized. Further, the connector 19 may be eliminated and the electric wires 20 may be made to pass along the venting tube 11.

Also as a modification, the venting tube 11 may be bent at its upper end and be provided with a cage containing a float. In this way, the venting tube 11 is automatically closed when the liquid reaches the upper level and the pressure is balaned with that of the filling line (for example at two absolute bars).

In this case, there is no need to use the pressure gauge device 21–22 and the electrically-operated valve 30, since the liquid is maintained automatically at the upper level and the injection of the liquid nitrogen through the conduit 14 can be effected at a certain pressure, so that it is for example possible to effect a spraying of liquid nitrogen on a given surface.

It will be understood that the device according to the invention is applicable to various cases where it is necessary to obtain a reliable and controlled injection of a pure cryogenic liquid, in particular at a low rate of flow. If desired, the conduit 14 may be connected to a horizontal manifold which is provided with a plurality of pouring orifices disposed at several points of a packing line, for example for rendering an object inert or cooling it locally.

What is claimed is:

1. A device for distributing a cryogenic liquid comprising:

a cryogenic container having a double wall and which is inverted in the position of use of the device and comprises an interior reservoir and an exterior case each defining a single opening at a lower end thereof, and a neck interconnecting the two openings;

a plate fixed in the neck at an entrance of the interior reservoir, and a cryogenic liquid supply conduit, a venting conduit and a pouring conduit, said three conduits extending through said plate in a sealed manner.

2. A device according to claim 1, comprising a connecting ring connecting the neck to the interior reservoir, said plate being detachably fixed to said ring.

3. A device according to claim 1, wherein the pouring conduit is provided with an electrically-operated stop valve located above the plate.

4. A device according to claim 3, comprising means for controlling the electrically-operated valve and also extending through the plate in a sealed manner.

5. A device according to claim 4, wherein the pouring conduit is provided, at the level of the plate and below the electrically-operated valve, with an insert defining a calibrated orifice whose diameter is much smaller than the diameter of said conduit.

6. A device according to claim 1, wherein a level measuring device also extends through the plate in a sealed manner.

7. A device according to claim 6, wherein the level measuring device comprises a tube which terminates in the interior reservoir in a downwardly open bell and which has an outer end for connection to a pressure gauge.

8. A device according to claim 1, wherein free space in the neck is filled with a thermally insulating material.

9. A device according to claim 1, comprising a ring provided with hooking means fixed on an upper end of the exterior case.

10. A device according to claim 1, comprising a sleeve provided with a handling handle fixed on a lower end of the exterior case.

11. A device according to claim 1, wherein all of the elements for supplying cryogenic liquid and optionally for supplying electric power and/or measuring the level are connected to a connection box carried by the container.

12. A device according to claim 1, wherein the venting conduit has an outer end portion in the form of a tunnel adapted to create a given atmosphere on objects which travel under the distributing device.

13. A device according to claim 1, wherein the venting conduit has an inner end provided with a cage enclosing a float, the cryogenic liquid supply conduit being, in use, directly connected to a supply of cryogenic liquid stored under pressure.

* * * * *